US008591016B2

(12) United States Patent
Leighton et al.

(10) Patent No.: US 8,591,016 B2
(45) Date of Patent: Nov. 26, 2013

(54) HIGH FLOW INK DELIVERY SYSTEM

(75) Inventors: Roger Gaylord Leighton, Hilton, NY (US); Michael Fredrick Leo, Penfield, NY (US); Nathan Eymard Smith, Hamlin, NY (US); David Peter Lomenzo, Pittsford, NY (US); Vincent M. Williams, Palmyra, NY (US); Patrick James Walker, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/595,705

(22) Filed: Aug. 27, 2012

(65) Prior Publication Data

US 2012/0320134 A1 Dec. 20, 2012

Related U.S. Application Data

(62) Division of application No. 12/775,844, filed on May 7, 2010, now Pat. No. 8,303,098.

(51) Int. Cl.
*B41J 2/175* (2006.01)

(52) U.S. Cl.
USPC ..... 347/88; 347/84; 347/85; 347/86

(58) Field of Classification Search
USPC ..... 347/84–86, 88–90
See application file for complete search history.

(56) References Cited

U.S. PATENT DOCUMENTS

| | | | | |
|---|---|---|---|---|
| 4,814,786 | A | 3/1989 | Hoisington et al. | |
| 5,489,925 | A * | 2/1996 | Brooks et al. | 347/6 |
| 5,757,390 | A | 5/1998 | Gragg et al. | |
| 5,992,990 | A | 11/1999 | Childers et al. | |
| 6,022,102 | A | 2/2000 | Ikkatai et al. | |
| 6,276,784 | B1 | 8/2001 | Ikkatai et al. | |
| 6,494,553 | B1 | 12/2002 | Donahue et al. | |
| 6,799,844 | B2 | 10/2004 | Leighton et al. | |
| 6,860,591 | B2 | 3/2005 | Slotto et al. | |
| 6,866,375 | B2 | 3/2005 | Leighton et al. | |
| 7,401,907 | B2 | 7/2008 | Perez | |
| 7,416,292 | B2 | 8/2008 | Leighton | |
| 7,475,971 | B2 | 1/2009 | Herbert et al. | |
| 7,604,333 | B2 | 10/2009 | Horsnell et al. | |
| 7,703,898 | B2 | 4/2010 | Klein Meuleman et al. | |
| 7,780,278 | B2 | 8/2010 | Brown et al. | |

(Continued)

FOREIGN PATENT DOCUMENTS

| | | | |
|---|---|---|---|
| EP | 0933217 | A3 | 8/1999 |
| EP | 1452322 | A1 | 9/2004 |
| WO | 2006078931 | A1 | 7/2006 |

OTHER PUBLICATIONS

United Kingdom Search Report corresponding to UK Application No. 1107364.0, United Kingdom Intellectual Property Office, Newport, South Wales, UK, Sep. 1, 2011 (3 pages).

*Primary Examiner* — Matthew Luu
*Assistant Examiner* — Rut Patel
(74) *Attorney, Agent, or Firm* — Maginot, Moore & Beck, LLP

(57) ABSTRACT

A method for delivering molten ink to a printing mechanism alternates between a first and second reservoir receiving molten ink from a receiving ink reservoir while providing ink from the other of the first and second reservoirs to a printing mechanism. The alternation of the two reservoirs is achieved with coordinated operation of two actuators operatively connected to two seal members.

6 Claims, 6 Drawing Sheets

(56) References Cited

U.S. PATENT DOCUMENTS

| | | | | |
|---|---|---|---|---|
| 7,878,637 | B2 | 2/2011 | Leighton | |
| 7,931,359 | B2 | 4/2011 | Esdaile-Watts et al. | |
| 2001/0019347 | A1 | 9/2001 | Hauck | |
| 2004/0174417 | A1 * | 9/2004 | Kobayashi et al. | 347/85 |
| 2006/0164472 | A1 | 7/2006 | Perez | |
| 2007/0002107 | A1 | 1/2007 | Leighton | |
| 2007/0076023 | A1 | 4/2007 | Knierim et al. | |
| 2009/0009574 | A1 | 1/2009 | Leighton | |
| 2010/0077855 | A1 | 4/2010 | McCracken et al. | |
| 2011/0141212 | A1 | 6/2011 | Smith et al. | |

* cited by examiner

HIGH FLOW INK DELIVERY SYSTEM

CLAIM OF PRIORITY

This application claims priority from U.S. application Ser. No. 12/775,844, which was filed on May 7, 2010, is entitled "High Flow Ink Delivery System," and which issued as U.S. Pat. No. 8,303,098 on Nov. 6, 2012.

TECHNICAL FIELD

The present disclosure generally relates to high speed printing machines which have one or more print heads that receive molten ink heated from solid ink elements. More specifically, the disclosure relates to improvements in pressurized ink transport.

BACKGROUND

So called "solid ink" printing machines encompass various imaging devices, including printers and multi-function platforms, which offer many advantages over other types of document reproduction technologies, such as laser and aqueous inkjet approaches. These advantages often include higher document throughput (i.e., the number of documents reproduced over a unit of time), fewer mechanical components needed in the actual image transfer process, fewer consumables to replace, sharper images, and an eco-friendlier process.

A typical solid ink or phase-change ink imaging device includes an ink loader which receives and stages solid ink elements that remain in solid form at room temperatures. The ink stock can be refilled by a user by simply adding more ink as needed to the ink loader. Separate loader channels are used for the different colors. For example, only black solid ink is needed for monochrome printing, while solid ink colors of black, cyan, yellow and magenta are typically needed for color printing. Solid ink or phase change inks are provided in various solid forms, and more particularly as pellets or as ink sticks.

An ink melt unit melts the ink by raising the temperature of the ink sufficiently above its melting point. During a melting phase of operation, the solid ink element contacts a melt plate or heated surface of a melt unit and the ink is melted in that region. The melted ink is often retained in a melt reservoir, which is itself heated to keep the ink above its solidification temperature until a print operation is demanded. The liquefied ink is supplied to a single or group of print heads by gravity, pump action, or both. In accordance with the image to be reproduced, and under the control of a printer controller, a rotating print drum receives ink droplets representing the image pixels to be transferred to paper or other media. To facilitate the image transfer process, a pressure roller presses the media against the print drum, whereby the ink is transferred from the print drum to the media. The temperature of the ink can be carefully regulated so that the ink fully solidifies just after the image transfer.

In higher throughput systems, the melted ink is pressurized for high speed delivery to the printheads. The throughput of such machines is ultimately controlled by the ability to maintain a constant supply of liquefied ink at the ready for delivery to the printheads. This ability is determined in part by the melt rate, i.e., the amount of solid ink that can be melted per unit time. In a typical ink stick system, the melt rates can vary between 6 and 16 gm/min. Higher melt rates can be often be achieved using solid ink pellets stored in a drum and fed to a high efficiency, high wattage melter. One such high volume melter is disclosed in commonly-owned U.S. patent application Ser. No. 12/638,863 (the '863 Application), which issued on Aug. 14, 2012 as U.S. Pat. No. 8,240,829, and is entitled "SOLID INK MELTER ASSEMBLY", the disclosure of which is incorporated herein by reference in its entirety. Melters of this type can achieve melt rates of up to 250 gm/min with sufficient power to exceed the ink's heat of fusion and the latent energy required to raise the ink to the final setpoint temperature for moving to the printheads.

There remains a need for a system capable of delivering ink to the print heads at a rate that can take full advantage of these high melt rates.

SUMMARY

According to aspects disclosed herein there is provided an ink delivery system for delivering molten ink to a printing mechanism comprising a receiving reservoir for receiving molten ink and a reservoir system in fluid communication between the receiving reservoir and a molten ink outlet in communication with the printing mechanism. The reservoir system includes: a first reservoir having a first inlet in communication with the receiving reservoir and a first outlet in communication with the molten ink outlet; a separate second reservoir having a second inlet in communication with the receiving reservoir and a second outlet in communication with the molten ink outlet; a first valve assembly disposed between the first inlet and the first outlet and including a first seal member movable between a discharge position closing the first inlet and an intake position closing the first outlet; a separate second valve assembly disposed between the second inlet and the second outlet and including a second seal member movable between a discharge position closing the second inlet and an intake position closing the second outlet; and an actuator assembly operably coupled to the first and second valve assemblies and configured for coordinated movement of the first and second seal members so that one of the seal members is in the discharge position and the other of the seal members is in the intake position. In another aspect, the reservoir system is incorporated into a printing machine comprising a heating element for melting solid ink, a receiving reservoir for receiving ink melted by the heating element, and a printing mechanism coupled to the molten ink outlet to receive molten ink under pressure from the reservoir system.

In a further aspect, a method for delivering molten ink to a printing mechanism is disclosed comprising: receiving molten ink in a receiving reservoir; preventing fluid communication between a first reservoir and the receiving reservoir while permitting fluid communication between the first reservoir and the printing mechanism; and substantially simultaneously permitting fluid communication between a second reservoir and the receiving reservoir while preventing fluid communication between the second reservoir and the printing mechanism.

A further method for delivering molten ink to a printing mechanism, comprises: receiving molten ink in a receiving reservoir; and alternating which of a plurality of reservoirs is opened to the receiving reservoir to receive molten ink while at least one other of the plurality of reservoirs is opened to dispense molten ink to the printing mechanism,

DETAILED DESCRIPTION

Figure 1:
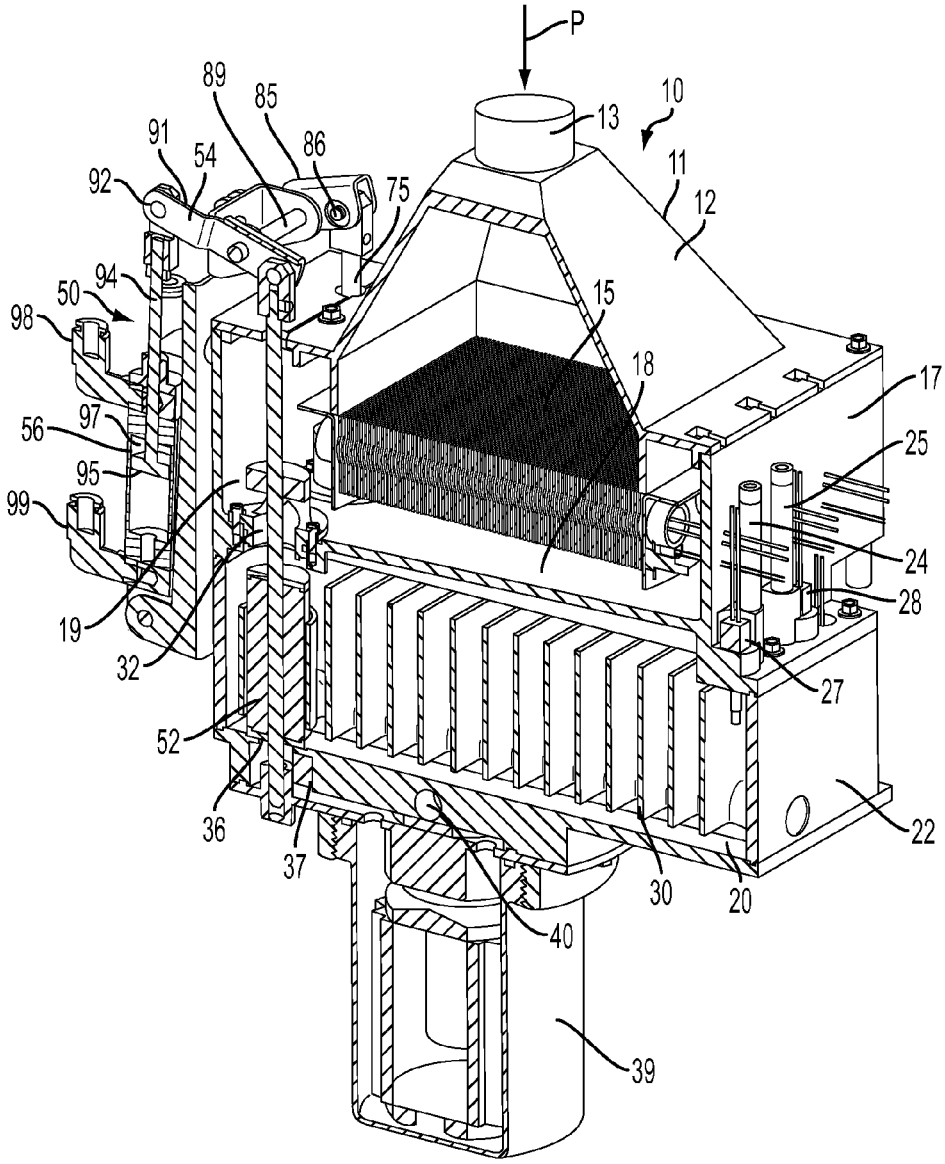
FIG. 1 is a perspective partial cut-away view of an ink delivery system according to the present disclosure.

Referring to FIG. 1, an ink delivery apparatus 10 includes a melting apparatus 11 configured to liquefy solid ink elements for eventual delivery to one or more printheads. In one embodiment, the solid ink elements are in pellet form. The melting apparatus 11 includes a pellet distributor 12 that receives solid ink pellets through an intake tube. The pellets may be obtained from an ink supply, such as a drum, by gravity feed or by a pressurized feed. The flow of solid ink pellets to the pellet distributor 12 may be regulated in a suitable manner to achieve optimum performance of the melting apparatus.

The melting apparatus 11 further includes a high efficiency melter 15. The melter 15 may be constructed as disclosed in the '863 Application, the disclosure of which has been incorporated herein by reference in its entirety. Details of the structure and operation of the melter can be learned from the '863 Application, the melter generally includes a plurality of heated fins onto which the solid ink pellets are dispensed. The pellets are continuously melted by the fins and drip between the fins into a low pressure reservoir 18, as shown in FIG. 1. In the illustrated embodiment, the low pressure reservoir may be formed by a housing 16 and may include a drip pan positioned directly beneath the melter 15, such as described in the '863 Application. The low pressure reservoir or drip pan 18 is configured to direct the melted ink toward a collection region 19 where the melted ink can be conveyed to the high pressure reservoirs described below.

The reservoir 18 is identified as "low pressure" because the reservoir is generally maintained at ambient pressure within the printing machine, or at a pressure less than the pressurized reservoirs described herein. Alternatively, the melting apparatus 11 may be slightly pressurized or maintained at atmospheric pressure.

In accordance with one feature, the ink delivery apparatus is provided with multiple high pressure reservoirs that are used to provide a continuous uninterrupted supply of melted ink to the one or more printheads. In one embodiment, two such reservoirs are provided, namely reservoirs 20 and 22, which are formed by a housing 17. The housing 17 may be integral with or separate from the housing 16 forming the low pressure reservoir. For purposes of the present disclosure, the reservoirs may be referred to as the first and second reservoirs or as reservoir 1 and reservoir 2. Like components of the reservoirs may also be designated with a subscript 1 or 2 to refer to the associated high pressure reservoir.

The reservoirs 20, 22 are connected at inputs 24, 25 to a pressure source, which may be an air pressure supply that is controlled and regulated by a controller (not shown) of the printing machine. The pressure in the reservoirs 20, 22 is sufficient to feed high pressure jets of the one or more printheads, as is known in the art. As explained in more detail herein, the reservoirs 20, 22 are periodically pressurized as the ink supply is discharged to the printhead(s) and de-pressurized as a new supply of molten ink is introduced into the reservoir.

Each high pressure reservoir 20, 22 may be provided with a corresponding ink level sensor 27, 28 that determines the volume or level of ink remaining in the reservoir. The sensors 27, 28 may be of any construction suitable for providing a signal indicative of the ink level and/or indicative of the ink level dropping to a threshold value. The sensor may be a mechanical float-type sensor or may be an electrical probe assembly such as the sensor assembly disclosed in and commonly-owned U.S. application Ser. No. 12/241,626, which issued on Nov. 29, 2011 as U.S. Pat. No. 8,065,913, and is entitled "INK LEVEL SENSOR", the disclosure of which is incorporated herein in its entirety.

Each high pressure reservoir 20, 22 may preferably include a heating element 30 that is operable to maintain the molten ink at a temperature above the solidification temperature of the ink. As shown in FIG. 1, the heating element 30 may include a plurality of spaced-apart heated fins to ensure a uniform heat distribution throughout the reservoir.

Figure 2:
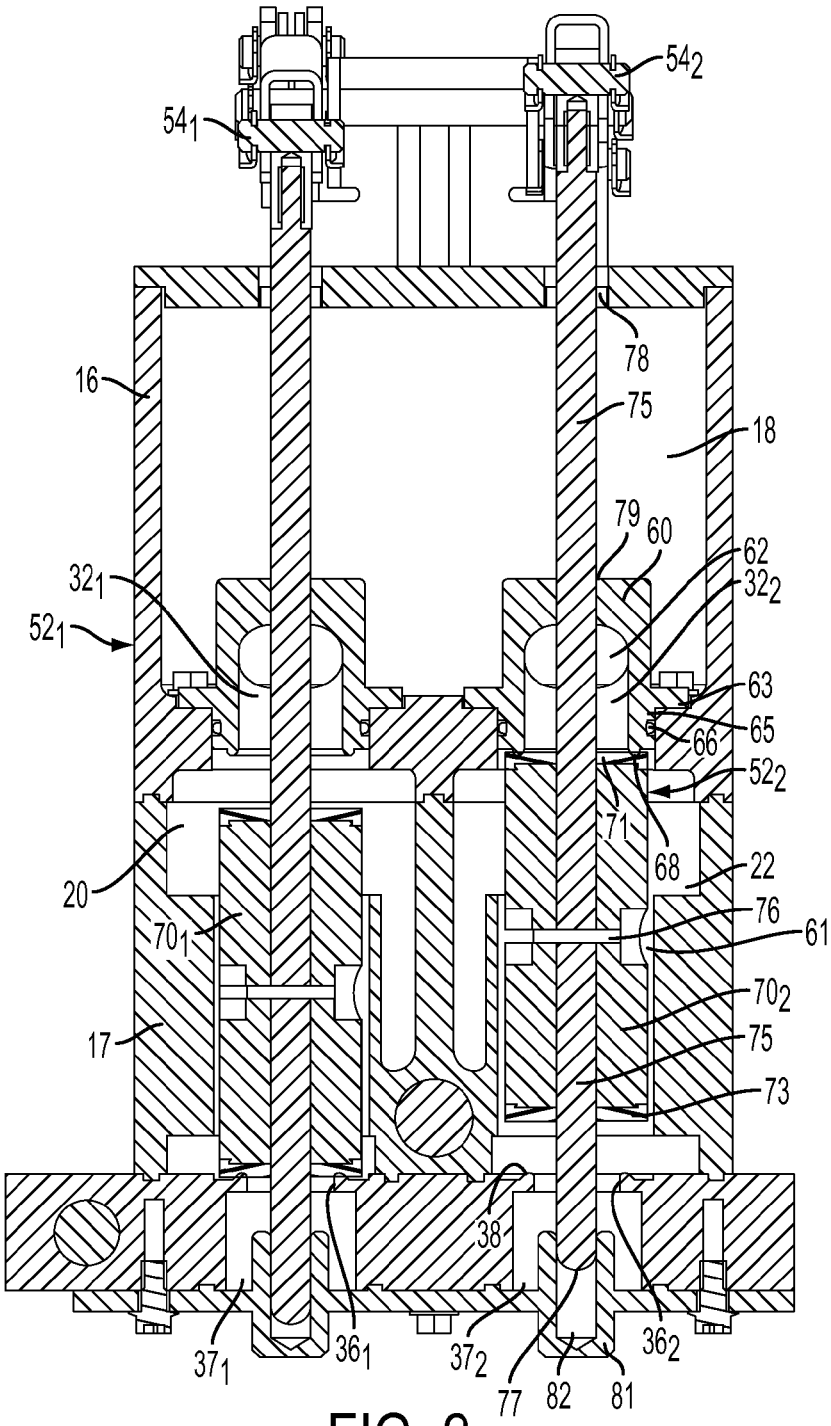
FIG. 2 is a side cross-sectional view of the ink delivery system shown in FIG. 1.

As shown in FIGS. 1-2, liquid ink is supplied from the low pressure reservoir 18 to each of the high pressure reservoirs 20, 22 through an inlet opening 32 (or inlet openings $\mathbf{32}_1$, $\mathbf{32}_2$ depicted in FIG. 2). Each reservoir also includes an outlet opening 36 (or openings $\mathbf{36}_1$, $\mathbf{36}_2$ shown in FIG. 2) that communicate with a common outlet channel 37 (or openings $\mathbf{37}_1$, $\mathbf{37}_2$ shown in FIG. 2). This outlet channel 37 is in communication with the printhead(s) and may incorporate a filter element 39 and a molten ink outlet 40 that feeds an outlet manifold (not shown) coupled to the printheads.

In operation, pressurized liquid ink is forced from the outlet channel 37, through the filter element 39 and outlet 40 to an array of tubing coupled to the printhead(s). The pressure in the outlet channel 37 is produced by pressure within an active one of the high pressure reservoirs 20, 22. The ink delivery apparatus 10 disclosed herein provides a mechanism for alternately fluidly coupling one high pressure reservoirs to the outlet channel to discharge molten ink to the printhead(s) while the other high pressure reservoir is fluidly coupled to the low pressure reservoir 18 to be re-filled with liquid ink. The apparatus 10 thus comprises an ink delivery control mechanism 50 that includes a valve assembly 52, a rocker assembly 54 and an actuator assembly 56.

Turning to FIG. 2, it can be seen that the valve assembly includes an assembly $\mathbf{52}_1$, $\mathbf{52}_2$ for each of the high pressure reservoirs. For the purposes of illustration, the valve assembly $\mathbf{52}_2$ will be described with the understanding that the valve assembly $\mathbf{52}_1$ may be substantially identically configured. The valve assembly $\mathbf{52}_2$ includes a valve seat body 60 disposed at or over the inlet opening $\mathbf{32}_2$. The valve seat body 60 defines one or more flow openings 62 that communicate between the low pressure reservoir 18 and the inlet opening $\mathbf{32}_2$. The valve seat body 60 may be provided with a mounting flange 63 that mates the body with the housing 17 defining the reservoir. The valve seat body 60 further includes a sealing hub 65 projecting from the mounting flange and configured to fit snugly within the inlet opening $\mathbf{32}_2$. The sealing hub 65 may include sealing element, such as O-ring 66 or flat rubber face seal washer, between the hub and the housing 17 defining the reservoir and inlet opening. The sealing hub 65 defines a sealing face 68 facing the outlet opening $\mathbf{37}_2$, as illustrated in FIG. 2.

The valve assembly $\mathbf{52}_2$ further includes a seal body 70 disposed for translation within a chamber 61 aligned between the inlet opening $\mathbf{32}_2$ and the outlet opening $\mathbf{37}_2$. The chamber 61 may be a portion defined by the housing 17 in the high pressure reservoir 22, or may be defined by a number of walls that help align and guide the seal body 70. In the latter case, the walls are preferably configured to ensure a constant supply of molten ink to the outlet opening $\mathbf{37}_2$ and sized to achieve max flow rate.

The seal body 70 includes an upper seal 71 and a lower seal 73. The upper seal is configured for sealed engagement with the sealing face 68 of the valve seat body 60 described above. The seal body $\mathbf{70}_2$ in FIG. 2 is shown in sealed contact or engagement with the sealing face 68—i.e., with the seal body in its uppermost position. One or both of the upper seal 71 and sealing face 68 may incorporate a compressible element and/or a recessed face operable to ensure a fluid and pressure tight seal with the seal body. In addition, the seal body and/or the upper seal may be configured for an enhanced fluid seal when pressure is applied behind the seal, such as when the high pressure reservoir 22 is pressurized to discharge molten ink to the printhead(s).

The seal body 70 is movable to a position for sealing contact or engagement with the sealing face 38 at the outlet opening $\mathbf{36}_2$. Thus, the seal body includes a lower seal 73 that is configured to achieve a fluid-tight seal with the sealing face. The seal body $\mathbf{70}_1$ on the left side of FIG. 2 is shown in this sealed contact with the outlet opening. It can be appreciated from FIG. 2 that the seal bodies $\mathbf{70}_1$, $\mathbf{70}_2$ forming part of the respective valve assembly $\mathbf{52}_1$, $\mathbf{52}_2$ may be substantially identical in construction, both bodies being configured to translate between an uppermost position sealing the inlet opening $\mathbf{32}_1$, $\mathbf{32}_2$, and a lowermost position sealing the corresponding outlet opening $\mathbf{36}_1$, $\mathbf{36}_2$.

It can be appreciated that the length of the seal body 70 is less than the distance between the opposed inlet and outlet openings in each high pressure reservoir. The length of the seal body is calibrated so that when the seal body is sealing one opening (such as inlet opening $\mathbf{32}_1$) the body does not impede ink flow through opposite opening (such as outlet opening $\mathbf{32}_2$). At the same time, it is desirable that the travel distance of the seal body 70 between its two positions be limited so that the time delay between "unsealing" one opening and sealing the opposite opening is minimized—i.e., so that the valve assembly is quick and responsive to a command to changer high pressure reservoirs. In one specific embodiment, the length of the seal body 70 is about 80-90% of the distance between the inlet and outlet openings in a given high pressure reservoir.

In order to accomplish this movement, each valve assembly 52 is driven by a corresponding rocker assembly 54. The rocker assembly includes a control rod 75 that extends downward through the housings 16, 17, and more particularly through the seal body 70. The control rod 75 may be fastened or affixed to the seal body in various manners, including with an attachment pin extending transversely through the rod and seal body, as depicted in FIG. 2, to facilitate assembly. In the illustrated embodiment, the control rod 75 is sized to extend through the height of both the low pressure and high pressure reservoirs. The rod thus passes through a sealed bore 78 entering the low pressure reservoir, through a rod bore 78 in the valve seat body 60 and ultimately into a bore 82 defined by a rod support cup 81 at the base of the high pressure reservoir or reservoir housing 17. The control rod 75 alignment is maintained by the rod bore 78 and the rod support cup 81 as the rod moves up and down between its two sealing positions.

As shown in FIG. 1, the control rod 75 is coupled to a clevis 85 by a pivot pin 86. The clevis 85 is pivotably mounted on an axle 89 supported on the ink delivery apparatus 10. The clevis 85 includes a link arm 91 that is connected to an actuator rod 94 by a pivot pin 92. The actuator rod 94 may be connected to a piston 95 of a pressure cylinder 97. The cylinder 97 is a hydraulic cylinder, and most preferably a pneumatic cylinder to make use of the pneumatics within many solid ink printing machines. The pressure cylinder 97 is provided with inlet/outlet openings 98, 99 at opposite ends of the cylinder, and more particularly on opposite sides of the piston 95. The pressure cylinder 97 is thus configured to drive the piston 95 upward or downward depending upon whether pressurized gas, such as air, is introduced through the lower opening 99 or upper opening 98.

It can be appreciated from FIG. 1 that as the piston 95 is driven upward by air pressure through inlet 99, the actuator rod 94 travels upward to pivot the link arm 91 clockwise about the axle 89. This clockwise rotation of the link arm 91 and clevis 85 drives the control rod 75 and seal body 70 downward to the position shown in FIG. 3. In this position the lower seal 73 is sealed against the sealing face 38 about the outlet opening $\mathbf{36}_1$. Conversely, when air pressure is released through air inlet 99 and introduced through inlet 98 at the top of pressure cylinder 97, the piston 95 is driven downward, pulling the actuator rod 94 with it. This movement pivots the link arm 91 and clevis 85 counter-clockwise about the axle 89, which in turn pulls the control rod 75 and seal body 70 upward until the upper seal 71 engages the sealing face 68, as shown in FIG. 4.

In lieu of providing pressurized air alternately to the two inlets 98, 99, the piston 95 may be spring-biased to one position or the other (for instance biased upward) and a single inlet, such as inlet 98, can be alternately pressurized to act against the spring bias or released to allow the piston to return under spring-bias. As a further alternative, the air cylinder can be replaced by other actuators such as a cam assy and stepper motor configured to drive the rocker arm into the two positions shown in FIGS. 3 and 4.

Figure 3:
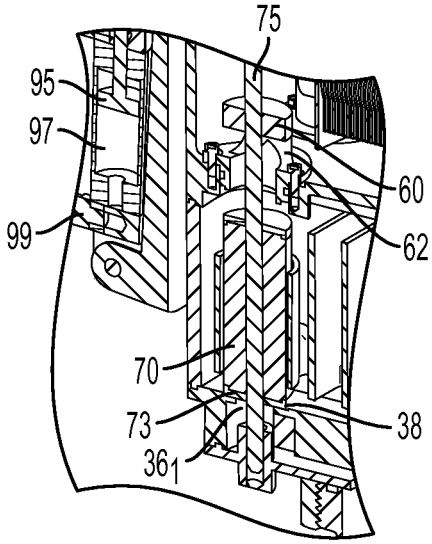
FIG. 3 is an enlarged view of components of the ink delivery system shown in FIG. 1, with the components in a first state.
Figure 4:
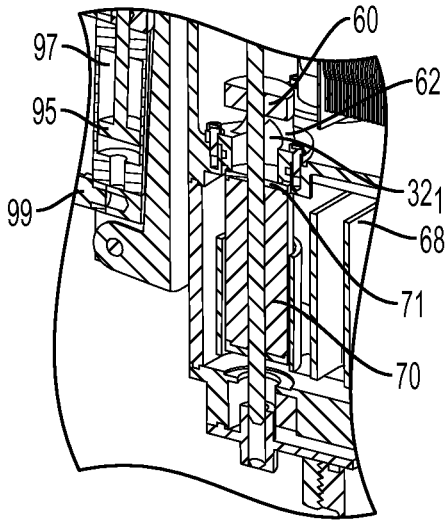
FIG. 4 is an enlarged view of components of the ink delivery system shown in FIG. 1, with the components in a second state.

In the position shown in FIG. 3, the outlet opening 36 from the high pressure reservoir is sealed by the lower seal 73 while at the same time the inlet opening 32 is open. In this position, the high pressure reservoir, for instance reservoir 20, can be filled by ink that has been previously melted in the low pressure reservoir 18. At the same time, pressure in the selected high pressure reservoir 20 is vented through its respective pressure input 24. The molten ink in the low pressure reservoir may flow by gravity through the inlet opening 32 until the high pressure reservoir 20 is filled, or until the molten ink in the low pressure reservoir 18 has been depleted. It may be contemplated that the melter 15 may be deactivated and the intake tube 13 to the pellet distributor 11 closed while the current supply of molten ink is being fed to the high pressure reservoir. It may also be contemplated that the heating element 30 within the particular high pressure reservoir being filled may be activated to keep the ink in its molten state.

While the high pressure reservoir 20 is being filled, the other high pressure reservoir 22 may be emptied by discharging its ink contents under pressure. The internal level of the ink inside the reservoir may be monitored via a low level sensor, such as the level sensor 28, to prevent emptying the contents and driving air into the system. (Air must be prevented from entering the reservoir which can causes the ink heads to burp and spray onto the substrate during a refill operation.) The high pressure reservoir 22 will thus have the seal body 70 in the position shown in FIG. 4 in which the upper seal 71 is sealed against the sealing face 68 to thereby close off the inlet opening 32. When the seal body is in its uppermost position, the outlet opening 36 is unimpeded. The pressure input 25 for the second high pressure reservoir 22 is activated to pressurize the reservoir and supply the molten ink under pressure to the printhead(s). At the same time, the heating element 30 may be deactivated. The low level sensor continuously monitors the ink level in the active reservoir, in this case reservoir 22, and generates a low level signal when the ink level drops to the threshold value. This low level signal initiates a switch of active reservoir from the reservoir 22 to the other reservoir 20, which by this time has been filled with molten ink.

It can be appreciated that the ink delivery control mechanism 50 disclosed herein provides a constant source of pressurized molten ink to be delivered to the printhead(s) by periodically switching between high pressure reservoirs 20, 22 feeding the molten ink. When one reservoir is "active" or "on-line"—i.e., supplying ink to the printhead(s)—the other reservoir can be re-filled from the low pressure reservoir. Once the ink in the active high pressure reservoir is at or near depletion, the control mechanism 50 can automatically open the other reservoir which has been filled with molten ink during its "inactive" or "off-line" state. The volumes in the chambers are sized so that the amount of ink buffered in both sides is sufficient to provide ink flow to meet the overall demand at maximum coverage on the substrate.

The coordinated action of the actuator assemblies 56 of the ink delivery control mechanism 50, the pressure inputs 24, 25 to the high pressure reservoirs, the melter 15 and the heating element 30 may be controlled by a suitable master control system (not shown). For instance, the master control system may control valves that either vent or supply pressurized air to the pressure inputs 24, 25. Likewise, the master control system may control valves that alternately vent and pressurize the air inlets 98, 99 for the pressure cylinder 97 in the actuator assembly 56 associated with each high pressure reservoir 20, 22. The master control system may be an electronic controller that is integrated into the printing machine and that may be operable to control other functions of the machine. The master control system may be programmable such as to change the ink level maximum and minimum thresholds, the air pressure provided to the actuator cylinders, any dwell in cylinder pressurization or de-pressurization, or other operating parameters of the ink delivery system.

In one approach, this coordinated action is keyed to the ink level within the two high pressure reservoirs, based on signals generated by the ink level sensors 27, 28 as interpreted by the master control system. At start-up, solid ink is initially dispensed to the inlet distributor 11 and the high efficiency melter 15 activated. The first high pressure reservoir 20 is then charged by closing the outlet 36 and opening the inlet 32. This step entails providing pressurized air to the air inlet 99 of cylinder 97 to drive the piston upward and the control rod 75 and seal body 70 downward to the position shown in FIG. 3. At the same time, the air inlet 98 to the other cylinder is pressurized to drive the corresponding piston downward, thereby pulling the control rod and seal body up to the position shown in FIG. 4. In this position, liquid ink will only flow to the first reservoir 20.

Figure 5:
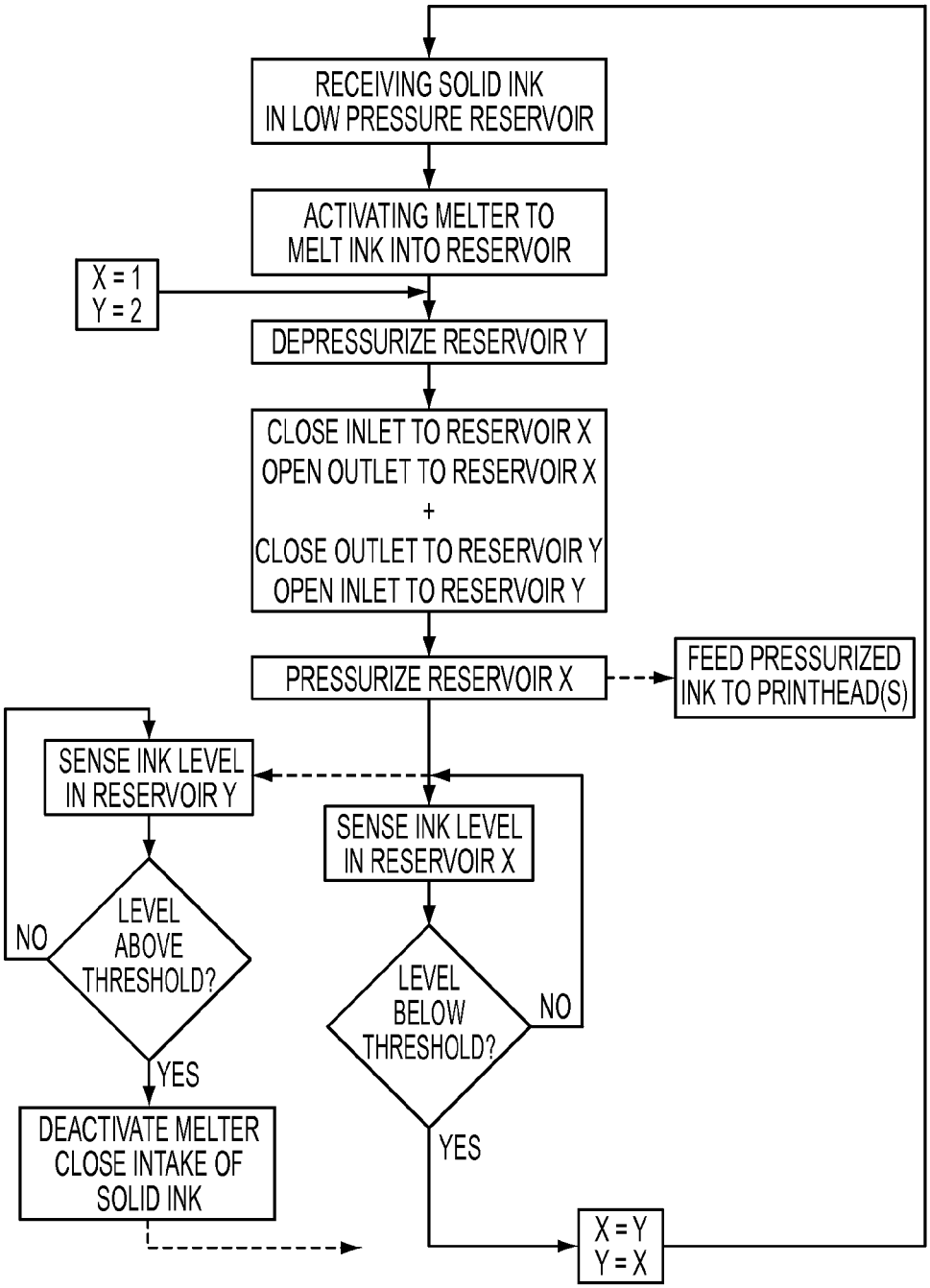
FIG. 5 is an operational flowchart for the ink delivery system shown in FIG. 1.

Once the first high pressure reservoir 20 is charged the control system may then implement a coordinated action as depicted in the flowchart of FIG. 5. On the first pass through series of steps, the reservoir "X" is the first reservoir 20, while the reservoir "Y" is the second reservoir 22. When a call is made for ink to be supplied to the printhead(s), the first step is depressurize the "inactive" reservoir, which in this first pass is the second reservoir 22. The inlet of the "active" Reservoir "X", in this case the first reservoir 20, is then closed and the outlet of that reservoir opened. Substantially concurrently, the inlet of Reservoir "Y", or in this case the second reservoir 22, is opened and the outlet closed. In the next step, Reservoir "X" that is now in communication with the printhead(s) is pressurized and pressurized ink is jetted through the outlet 40 to the printhead(s) in a suitable manner.

As the ink is being utilized by the printheads, the "offline" reservoir is being refilled. Consequently, in the next step, the melter 15 in the low pressure reservoir is activated and the intake tube 12 opened to begin melting the solid ink. Since the Reservoir "Y" is open to the low pressure reservoir, the melted ink is continuously fed to the inactive Reservoir "Y". In one branch of the flowchart of FIG. 5, the control system continuously monitors the ink level in the Reservoir "Y". Once the reservoir is full—i.e., when the ink level reaches a predetermined "full" threshold—the control system deactivates the melter and closes the intake tube to the pellet distributor.

Concurrently, the control system also monitors the ink level in the "active" Reservoir "X". When the ink level drops below a predetermined threshold indicative of a depleted or nearly depleted reservoir, the control system switches the two reservoirs and re-starts the sequence of steps to activate the previously inactive Reservoir "Y" and replenish or recharge the previously activated Reservoir "X". It can be appreciated that the sequence of steps in the flowchart of FIG. 5 may be continuously repeated as each newly recharged reservoir is depleted. In one embodiment, the timing of the steps is based on the ink level in the active reservoir so that switching of the reservoirs only occurs when the active reservoir is sufficiently depleted but prior to complete emptying of the active reservoir. It is contemplated that the low ink level threshold arises before all of the molten ink has been discharged from the active high pressure reservoir so that there will be only a negligible interruption in molten ink fed to the printhead(s), even for asynchronous printheads that do not demand ink flow all at the same time.

Figure 6:
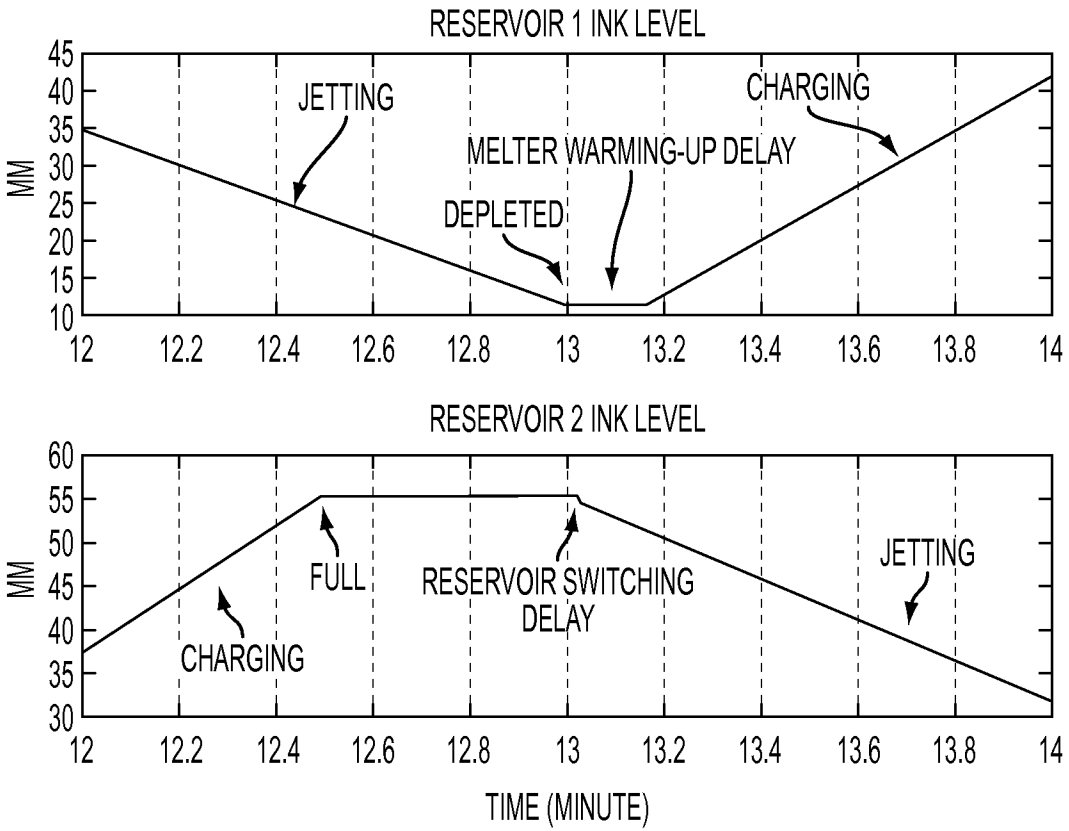
FIG. 6 are comparative graphs of ink levels in two reservoir components of the ink delivery system shown in FIG. 1.
Figure 7:
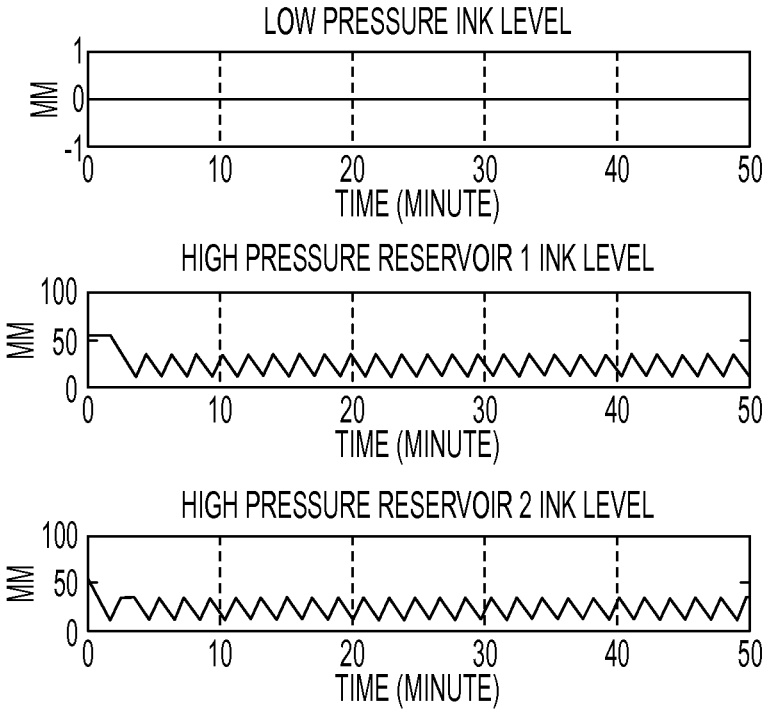
FIG. 7 are comparative graphs of ink levels in three reservoir components of the ink delivery system shown in FIG. 1.

The ink levels in a two reservoir system are illustrated in the graphs of FIGS. 6 and 7. As shown in FIG. 7, the molten ink in the first reservoir is being generally uniformly depleted while the ink in the inactive reservoir is generally uniformly recharged or replenished. It can be seen that the inactive reservoir becomes fully charged well prior to when the active reservoir reaches its depletion threshold. It can be appreciated that the slope of the "charging" line for the reservoirs can be calibrated in part by controlling the melter 15 feeding the low pressure reservoir 18. The rate of charging may also be tuned to the usage rate of the active reservoir—i.e., a slower usage rate does not require rapid recharging of the inactive reservoir.

As depicted in FIG. 6, the ink level Reservoir 1 was reduced to the threshold value at about the time 13 minutes. The control system thus commanded a switch (as indicated in FIG. 5) and after a slight delay the second reservoir is activated to begin jetting molten ink to the printhead(s). There is a delay in supplying ink to the newly inactivated reservoir due to the need to warm up the melter 15. Once warmed up, the melter begins to recharge the depleted reservoir. As can be seen in the graphs of FIG. 7, this cycle of depletion and recharging is uniformly cyclical and can continue indefinitely as long as solid ink is continuously fed to the melting apparatus 11. It can also be seen that the ink level in the low pressure reservoir remains at or very near zero since solid ink is only melted when a high pressure reservoir requires recharging and since the inlet opening between the low pressure reservoir and high pressure reservoir is open throughout the melting process.

In the illustrated embodiment, the seal body 70 is an elongated generally cylindrical body. The length of the seal body 70 is dictated in part by the distance between the inlet opening 32 and the outlet opening 36 in each high pressure reservoir

20, 22. It is important that the seal body remain substantially clear of one opening when sealing the other opening so that the seal body does not adversely impact the flow of ink through the respective opening. The need for this sufficient gap is particularly important at the outlet opening 36 to avoid any turbulence as the ink is discharged under pressure.

The seal body 70 is depicted in the present disclosure as a generally solid body. Alternatively, the seal body may constitute separate seals at the upper and lower positions on the control rod 75, provided that the separate seals can exert sufficient sealing pressure against the respective sealing face 38, 68, In the illustrated embodiment the seal bodies are moved upward and downward by the rocker assembly 54 and actuator assembly 56. Other mechanisms are contemplated to achieve the coordinated movement of the seal bodies within the high pressure reservoirs 20, 22. For instance, each control rod 75 may be an element of a linear actuator, without the rocker assembly 54. In another alternative, the pressure cylinder 97 may be replaced by a mechanical actuator suitable to alternately translate the seal body 70 upward and downward. For instance, a cam and stepper motor may be configured to pivot the clevis 85 and link arm 91 or, alternatively, to directly reciprocate the control rods 75. In this case, the control system would be operable to send electrical control signals to a motor driver to control the operation of the stepper motor.

In certain applications individual control of the valve assemblies for the different high pressure reservoirs is needed. Alternatively, the movement of the seal bodies 70 within the reservoirs can be coordinated through a common actuator assembly. In this alternative, for instance, the control rods of two high pressure reservoir seal bodies can be attached at opposite ends of a single rocker arm. Pivoting the rocker arm alternately and simultaneously raises one control rod and seal body and lowers the other. In another alternative, the two rocker arms may be coupled to a single hydraulic cylinder so that upward movement of the piston pivots one rocker arm to a discharge position, for instance, while downward movement of the piston pivots the other rocker arm to the discharge position. As a further alternative, the relative movement of the seal bodies may be administered through a cam arrangement to, for instance, introduce a dwell period before raising or lowering a respective seal body.

In the present disclosure, two high pressure reservoirs 20 and 22 are provided. The ink delivery control mechanism 50 may be modified to accommodate more than two reservoirs. Appropriate changes may be implemented in the master control system to account for the timing of movement of the seal bodies and pressurization/depressurization of each of the additional high pressure reservoirs, all with the goal of ensuring a constant supply of pressurized melted ink to the printhead(s). In the case of three or more high pressure reservoirs, it can be contemplated that the inactive reservoirs may be simultaneously re-filled with molten ink from the low pressure reservoir while their respective outlets are closed by the seal body. This configuration may require a larger low pressure reservoir to melt enough ink to fill more than one high pressure reservoir.

It will be appreciated that various of the above-described features and functions, as well as other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A method for delivering molten ink to a printing mechanism, comprising:

receiving molten ink in a receiving reservoir;

operating a first actuator operatively connected to a first seal member in a first reservoir that is configured to move between an intake position that permits fluid communication between a first inlet of the first reservoir and the receiving reservoir while preventing fluid communication between a first outlet of the first reservoir and the printing mechanism by sealing the first outlet of the first reservoir with the first seal member, and a discharge position that permits fluid communication between the first outlet of the first reservoir and the printing mechanism while preventing fluid communication between the first inlet of the first reservoir and the receiving reservoir by sealing the first inlet of the first reservoir with the first seal member; and operating a second actuator operatively connected to a second seal member in a second reservoir that is configured to move between an intake position that permits fluid communication between a first inlet of the second reservoir and the receiving reservoir while preventing fluid communication between a first outlet of the second reservoir and the printing mechanism by sealing the first outlet of the second reservoir with the second seal member, and a discharge position that permits fluid communication between the first outlet of the second reservoir and the printing mechanism while preventing fluid communication between the first inlet of the second reservoir and the receiving reservoir by sealing the first inlet of the second reservoir with the second seal member, the operation of the first actuator and the second actuator being coordinated so the first seal is in the intake position when the second seal is in the discharge position and the first seal is in the discharge position when the second seal is in the intake position.

2. The method of claim 1 further comprising pressurizing the first reservoir.

3. The method of claim 1, the receiving of molten ink in the receiving reservoir further comprising:

activating a heating element for melting solid ink and feeding solid ink into contact with the heating element.

4. The method of claim 3, the receiving of molten ink in the receiving reservoir further comprising:

deactivating the heating element when the receiving reservoir is full of molten ink.

5. The method of claim 1, the receiving of molten ink in the receiving reservoir further comprising:

receiving only a quantity of ink that is sufficient to substantially fill one of the first and second reservoirs.

6. The method according to claim 1, the operation of the first actuator and the second actuator further comprising:

operating the first and the second actuators in response to a level of ink in one of the first and the second reservoirs dispensing molten ink to the printing mechanism.

* * * * *